United States Patent [19]

Faria et al.

[11] Patent Number: 4,711,650

[45] Date of Patent: Dec. 8, 1987

[54] SEAL-LESS CRYOGENIC EXPANDER

[75] Inventors: Lawrence E. Faria, Hudson; Earl H. Christopher, Lynnfield, both of Mass.

[73] Assignee: Raytheon Company, Lexington, Mass.

[21] Appl. No.: 903,540

[22] Filed: Sep. 4, 1986

[51] Int. Cl.[4] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 1,275,507 | 8/1918 | Vuilleumier . | |
| 3,296,808 | 1/1967 | Malik | 62/6 |
| 3,367,121 | 2/1968 | Higa | 62/6 |
| 3,421,331 | 1/1969 | Higa | 62/6 |
| 3,877,239 | 4/1975 | Leo | 62/6 |
| 3,991,586 | 11/1976 | Acord | 62/6 |
| 4,024,727 | 5/1977 | Berry et al. | 62/6 |
| 4,074,908 | 2/1978 | Spencer | 277/44 |
| 4,475,346 | 10/1984 | Young et al. | 62/6 |
| 4,501,120 | 2/1985 | Holland | 62/6 |
| 4,514,987 | 5/1985 | Pundak et al. | 62/6 |
| 4,539,818 | 9/1985 | Holland | 62/6 |
| 4,550,571 | 11/1985 | Bertsch | 62/6 |

*Primary Examiner*—Albert J. Makay
*Assistant Examiner*—Steven E. Warner
*Attorney, Agent, or Firm*—Philip J. McFarland

[57] ABSTRACT

A cryogenic refrigerator operating on the Split-Sterling cycle principle is disclosed. The refrigerator has a seal-less expander and achieves efficient operation without the use of external control apparatus. This is accomplished by sizing the expander so that two pressure differential forces developed across a displacer in the expander are approximately equal in magnitude. For efficient operation, the expander's gas flow rate is selected to provide the proper time delay between the two pressure differential forces.

20 Claims, 4 Drawing Figures

SEAL-LESS CRYOGENIC EXPANDER

BACKGROUND OF THE INVENTION

This invention relates to refrigeration systems and more particularly to a seal-less expander for use in split Stirling cycle refrigerators.

The need for cooling infrared detectors to cryogenic temperatures is often met by miniature refrigerators operating on the split Stirling cycle principle. As is well known, these refrigerators use a motor driven compressor to provide a pressurized refrigeration gas with a nearly sinusoidal pressure variation, an expander to cool the gas, and a gas transfer line to feed the pressurized gas from the compressor to the expander.

The expander is typically a metal cylinder with two isolated cavities formed therein. One cavity, called a spring volume, is filled with refrigeration gas held at a nearly constant pressure. The other cavity, called the working volume, is also filled with refrigeration gas and receives the gas fed from the compressor via the transfer line. The pressure of the gas in the working volume is thereby made to oscillate above and below the spring volume pressure. Another metal cylinder called a displacer is disposed within the expander so that one end of the displacer extends into the spring volume and the other end extends into the working volume.

The displacer is free to reciprocate in response to the varying pressure of the gas in the working volume. The displacer reciprocates because when the spring volume pressure is less than the working volume pressure, a force on the displacer is created causing it to move so that more of the displacer extends into the spring volume. When the spring volume pressure exceeds the working volume pressure, the displacer is again forced to move in the opposite direction, out of the spring volume and into the working volume.

The displacer also contains a regenerative heat exchanger (regenerator). Openings formed in the displacer allow the gas in the working volume to access the regenerator. As the displacer reciprocates, working volume gas is forced to flow through the regenerator first in one direction and then the other. This in turn causes the gas to be alternately cooled and warmed, so that gas in one end of the working volume (a cold space) becomes colder than ambient, and gas in the other end (a warm space) becomes warmer than ambient. An infrared detector or other device to be cooled is thus mounted adjacent the cold space in the working volume.

It is known that efficiency of the expander can be increased by retarding the movement of the displacer until the pressure of the gas in the working volume is near maximum. This allows almost all of the gas in the working volume to be compressed and thus warmed before being forced to flow through the regenerator. The gas is then as cold as possible when entering the cold end of the working volume. Likewise, retarding the opposite motion of the displacer until the pressure in the working volume is near minimum causes as much gas as possible to be expanded and hence cooled before being forced out of the cold end and back through the regenerator.

Retarding the motion of the displacer is primarily the function of a displacer friction seal disposed so as to contact the outer diameter of the displacer. A major problem has been that these friction seals change their braking action unpredictably as they wear, thereby adversely affecting cooling efficiency. U.S. Pat. No. 4,074,908 to Spencer discloses a polymeric seal exhibiting long wear life. Others have replaced the friction seal with a clearance type seal and provided other means for delaying or trimming the motion of displacer 14. For example, U.S. Pat. No. 4,514,987 to Pundak, et al. discloses the use of an electromagnetic field to produce mechanical drag on the displacer. U.S. Pat. No. 4,475,346 to Young, et al. discloses an electrically powered linear drive motor for trimming the movement of the displacer. In addition to increasing the mechanical complexity of the expander, these auxiliary motion retarding mechanisms increase the necessary number of external connections to the expander. This in turn complicates the mounting of the expander and the infrared detector on the gimbals necessary for steering.

SUMMARY OF THE INVENTION

With the foregoing background of the invention in mind, it is therefore an object of the present invention to provide an expander for use in a split Stirling cycle refrigerator having properly phased displacer movement without using friction type seals.

It is another object of the present invention to provide such an expander without external displacer motion controlling apparatus and the attendant increase in system complexity and difficulty in gimbal mounting.

A further object of the present invention is to provide a simplified displacer design.

These and other objects of the present invention are met by providing an expander having a precision clearance type seal to isolate the warm space and cold space, the expander also having a displacer with a plunger and regenerator such that the amplitude of a plunger force equal to the area of the plunger times the maximum difference between warm space pressure and spring volume pressure is approximately equal to amplitude of a regenerator force equal to the cross-sectional area of the regenerator times the maximum difference between warm space pressure and cold space pressure, the regenerator also having a gas flow rate such that the phasing of the plunger force with respect to the regenerator force causes the displacer to move only when the working volume pressure nears minimum or maximum.

BRIEF DESCRIPTION OF THE DRAWINGS

The foregoing and other objects, advantages and novel features of the present invention will become obvious from the following detailed description when considered together with the accompanying drawings in which.

DETAILED DESCRIPTION OF THE PREFERRED EMBODIMENT

Figure 1:
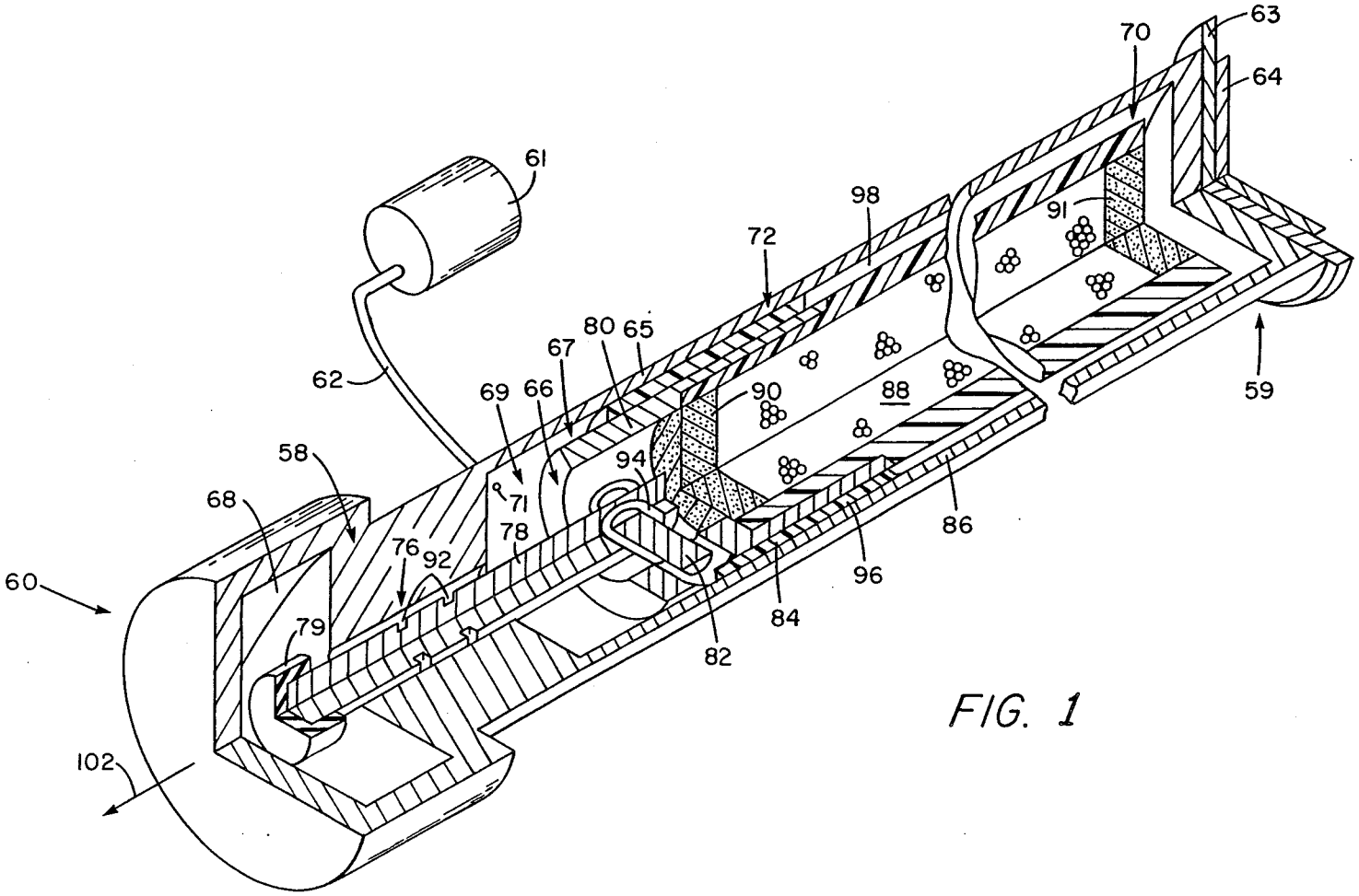
FIG. 1 is an isometric cut-away view of an expander according to the present invention.

Turning attention now to the drawings, in which like reference characters indicate like or corresponding parts throughout the several views, there is shown in FIG. 1 an isometric cut-away view of the present invention. In particular, an expander 60 is shown operably connected to a compressor 61 by means of a gas transfer line 62. Compressor 61 provides a refrigeration gas (such as helium) with a substantially sinusoidal pressure variation to expander 60 via transfer line 62. Expander 60 operates on this gas, thereby causing a cold tip 63 to become colder than the ambient temperature. Cold tip 63 is mounted on one end of expander 60 and is preferably formed as slab of material exhibiting good heat transfer properties, such as copper. Infrared detector 64 or other such object to be cooled is mounted on the side of cold tip 63 opposite expander 60. The end of expander 60 on which cold tip 63 is mounted is referred to as the cold end 59.

A more detailed description of the components and operation of expander 60 leads to an understanding of why cold tip 63 becomes cold. Expander 60 comprises expander housing 65 and displacer 66. Expander housing 65 and displacer 66 are preferably stainless steel cylinders. Two cavities, namely a main cavity (not numbered) and spring volume 68, are formed in expander housing 65. Spring volume 68 is formed in the end of expander housing 65 opposite cold end 59. This end of expander 60 opposite cold end 59 is referred to as the warm end 58. Expander housing 65 may be formed from a single piece of metal or as a brazed assembly. The main cavity (not numbered) is divided into a warm space 69 and a cold space 70, with cold space 70 being the end of main cavity 67 adjacent cold tip 63. The pressurized refrigeration gas in transfer line 62 is fed to warm space 69 through a gas port 71 formed in the wall of expander housing 65 adjacent warm space 69. As will be described in greater detail shortly, displacer seal 72 serves to prevent direct communication of the gas in warm space 69 with the gas in cold space 70.

Spring volume 68 is also filled with a refrigeration gas. The gas pressure inside spring volume 68 is held at a constant pressure approximately equal to the average pressure in warm space 69. A plunger seal 76 serves to isolate the gas in spring volume 68 from the gas in warm space 69. Because plunger seal 76 will not be 100 percent effective, spring volume 68 must be at least large enough so that any effect of gas leaking past plunger seal 76 to and from warm space 69 is minimal.

It is also evident from FIG. 1 that displacer 66 comprises plunger 78, bumper 79, adapter 80, pin 82 and regenerator 84. Regenerator 84 comprises a tube 86 filled with heat exchange media 88, and two plugs, warm end plug 90 and cold end plug 91. Heat exchange media 88 preferably comprises small diameter metallic balls or powder. It is the function of end plugs 90 and 91 to hold heat exchange media 88 within exiting tube 86. End plugs 90 and 91 are preferably formed of a porous material such as sintered bronze that allows refrigeration gas to flow between warm space 69 and cold space 70 through regenerator 84 while still retaining heat exchange media 88. Regenerator 84 preferably has a low heat conduction characteristic in the longitudinal direction between warm space 69 and cold space 70 thereby allowing a large temperature gradient to be maintained between warm space 69 and cold space 70. Also as will be seen shortly, regenerator 84 must be properly sized to provide the proper gas flow rate between warm space 69 and cold space 70 so that efficient operation of expander 60 occurs.

Displacer 66 is free to reciprocate inside expander housing 65 in response to the sinusoidal pressure variations in warm space 69. The various components of displacer assembly 66 will be described in more detail before proceeding to a discussion of how displacer 66 reciprocates. In particular, plunger 78 is preferably a metallic shaft extending from warm space 69 into the spring volume 68. Plunger 78 is small enough in cross-sectional area with respect to the area of spring volume 68 so that the action of plunger 78 moving in and out of spring volume 68 does not substantially affect the gas pressure in spring volume 68. A bumper 79 formed of a resilient material such as rubber may be attached to the end of plunger 78 adjacent spring volume 68. The function of bumper 79 is to prevent plunger 78 from striking expander housing 65, However, as will be seen shortly, in normal operation of expander 60, plunger 78 will not strike housing 65 so that bumper 79 is not absolutely necessary. As previously mentioned, it is the function of plunger seal 76 to prevent sealed gas in spring volume 68 from mixing with the gas in warm space 69. Plunger seal 76 is preferably a clearance type seal of the type wherein the diametral clearance between plunger 78 and the portion of expander housing 65 adjacent plunger 78 is closely controlled. Ideally plunger 78 does not touch housing 65 as displacer 66 reciprocates. Thus, the sealing function is provided with little or no sliding friction force. Annular notches 92 formed on the outer diameter of plunger 78 assist in the sealing function of plunger seal 76.

Plunger 78 is connected to adapter 80 by means of pin 82, pin 82 being press fit through holes formed in plunger 78 and adapter 80. The clearance between the outer diameter of pin 82 and the hole 94 formed in plunger 78 and the hole 96 formed in housing 80 is sufficiently large to provide universal action between plunger 78 and adapter 80. This universal action assists in compensating for allowable tolerances in the sizing of plunger 78 and adapter 80. This pin-through-hole arrangement has been found simpler to assemble and disassemble than other arrangements.

Adapter 80 is attached to the outer diameter of tube 86 of regenerator 84. Adapter 80 is preferably a stainless steel cylinder, but may also be formed of ceramic. As tube 86 is usually formed of a light weight material such as fiberglass or plastic, adapter 80 will also provide a longer wear life if displacer 66 contacts expander housing 65 while reciprocating. Adapter 80 has a hole formed along its major longitudinal axis to allow gas in warm space 69 to reach warm space plug 90 of regenerator 84.

As previously mentioned, it is the function of displacer seal 72 to prevent direct communication between warm space 69 and cold space 70, thereby forcing gas to flow through regenerator 84. Displacer seal 72 is a clearance type seal imparting little or no friction on displacer 66 as it reciprocates, in much the same manner as plunger seal 76. Displacer seal 72 may be embodied in a number of different forms, but all forms involve tight control of the clearance between adapter 80 and expander housing 65. The materials selected for expander housing 65, displacer seal 72, and adapter 80 must exhibit similar thermal growth so as to maintain control of the clearance over temperature. For example, if expander housing 65 and adapter 80 are stainless steel, displacer seal 72 may be embodied as a sleeve of polyimide compounded with molybdenum disulfide lubricant, such as Vespel SP3, a product of the E. I. DuPont de Nemours Corporation (DuPont). A sleeve of this material is bonded to adapter 80 and then lapped to provide a proper clearance between the outer diameter of displacer seal 72 and the inner diameter of expander housing 65.

Figure 2:
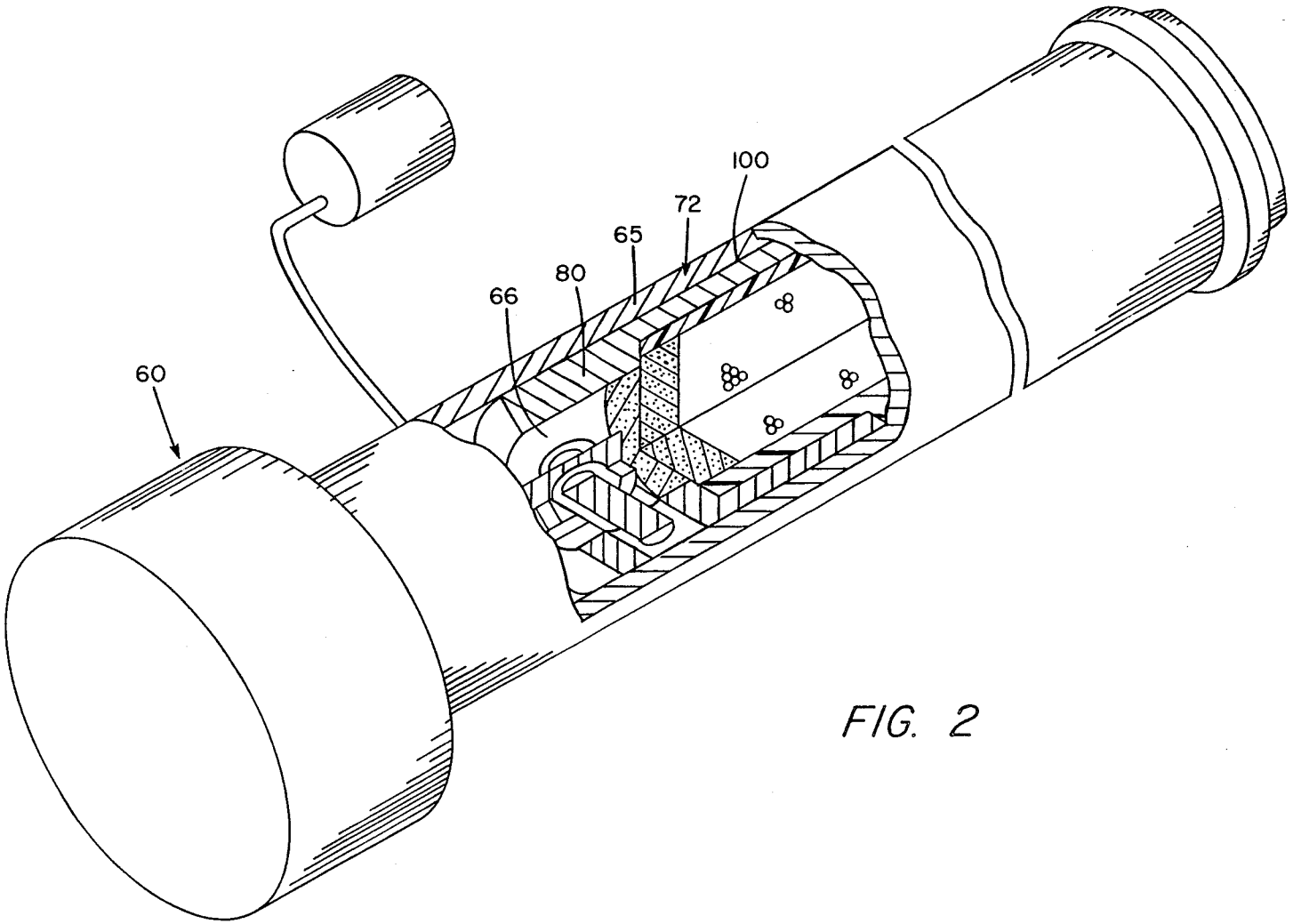
FIG. 2 is an isometric cut-away view of an alternate embodiment of the present invention.

An alternative embodiment for displacer seal 72 is shown in the partial cut-away view of expander 60 shown in FIG. 2. In this embodiment displacer seal 72 is a coating sprayed on the outer diameter of adapter 80. One such coating found to perform well is a polyimide compounded with Teflon. Teflon is a trademark of E. I. DuPont de Nemours Corporation for its tetrafluroethylene resins. The preferred Teflon-compounded polyimide is Xylan, a trademark of the Whitford Corporation of West Chester, Pa. for fluropolymers. The coating is sprayed onto adapter 80 in liquid form and cured by heating adapter 80 to a high temperature. This coating is preferable as it has been found to cause minimal scratching of expander housing 65 as displacer 66 reciprocates. Any such scratching produces contaminants which over time reduce the efficiency of operation of expander 60.

Returning attention to FIG. 1, the cyclic operation of expander 60 in accordance with the present invention will now be described. At the beginning of the cycle, displacer 66 is positioned such that warm space 69 is near its maximum volume and cold space 70 is near its minimum volume. The gas pressure of warm space 69 is also near its minimum. As the gas pressure of warm space 69 increases beyond the gas pressure of spring volume 68, a force is created across plunger 78. This portion of the cycle is known as compression with heat rejection to the environment. The force created on plunger 78 tends to urge plunger 78 and hence the entire displacer assembly 66 to move in the direction of arrow 102. Once this plunger force is greater than the inertia and any other retarding forces, displacer 66 will move rapidly in the direction of arrow 102. This motion of displacer 66 compresses the volume of warm space 69 and forces the pressurized gas in warm space 69 to flow rapidly through regenerator 84. The gas is cooled as it flows through regenerator 84 and exits through cold end plug 91 into cold space 70. Cooling occurs because of the heat absorption action of heat exchange media 88 and also because the pressure of the now expanded cold space 70 has decreased. This process is called the constant volume cooling portion of the cycle.

Displacer 66 now dwells in this position, as the pressure in warm space begins to decrease. This is the expansion with heat flowing from the environment portion of the cycle. Meanwhile, the pressure in warm space 69 at some point decreases below the pressure of spring volume 68, thereby creating a force in the direction opposite that of arrow 102. Once this force overcomes inertia and other forces on displacer 66, the displacer 66 will return to the position shown in FIG. 2. Upon this movement of displacer 66, the gas in cold space 70 is again forced through regenerator 88. This in turn causes the gas to be warmed as it exits from warm end plug 90 into warm space 69. This part of the cycle is known as constant volume heating. The cycle then repeats.

Applicants have discovered that, contrary to the prior teachings, neither friction at seals 76 and 72 nor external control or trimming of the movement of displacer 66 is necessary to achieve efficient operation of expander 63. Rather, if the force occuring on displacer 66 due to the pressure differential between warm space 69 and working volume 68 as well as the force on displacer 66 due to the pressure differential between cold space 70 and warm space 69 are properly balanced and phased by adjusting the flow rate of regenerator 84, efficient operation can be obtained. For this to occur, it is imperative that careful attention be paid to keeping seals 72 and 76 as frictionless as possible and also to keeping contaminants out of main cavity 67.

To appreciate this further, consider a general equation describing the forces on displacer 66 with respect to time:

$$f_p(t)+f_r(t)+f_s(t)+e(t)=M_a(t) \quad (1)$$

where $f_p(t)$ is the force on the end of displacer 66 adjacent plunger 68, primarily due to the pressure differential between warm space 69 and working volume 68, $f_r(t)$ is the force on displacer 66 adjacent the end of regenerator 84 nearest cold space 70, primarily due to the pressure differential between cold space 70 and warm space 69, $f_s(t)$ is the sliding friction force due seals 72 and 76 and $M_a(t)$ is the inertia force on displacer 66, and e(t) is an error term. Other dynamic forces act on the displacer 66 dynamically, and the intent of equation (1) is to only generally describe its motion. The term e(t) is thus meant to represent other dynamic effects such as gas friction, pressure variations dependent on temperature, etc.

If the friction force $f_s(t)$ is very small with respect to the other forces, it can be ignored and the equation rewritten as:

$$[p_w(t)-p_s]a_p+[p_w(t)-p_c(t)]a_r=M_a(t)-e(t) \quad (2)$$

where $p_w(t)$ is the sinusoidally varying pressure of the gas in warm space 69, $p_c(t)$ is the pressure of the gas in cold space 70, $p_s$ is the constant pressure of spring volume 68 and $a_p$ and $a_r$ denote the cross-sectional areas of plunger 78 and the portion of regenerator 84 adjacent cold space 70, respectively.

If the gas pressure $p_c(t)$ in cold space 70 is approximately equal to the gas pressure $p_w(t)$ in warm space 69 delayed by the time, $\tau$, that it takes for the gas to flow through regenerator 84, the equation becomes:

$$[p_w(t)-p_s]a_p+[p_w(t)-p_w(t-\tau)]a_r=M_a(t)-e(t) \quad (3)$$

It can now be seen that the inertia force $M_a(t)$ determining the movement of displacer 66 varies primarily as the pressure wave form $p_w(t)$, and can be adjusted by changing the two cross sectional areas $a_p$ and $a_r$ and the time delay $\tau$. Thus with optimum selection of these parameters, the design of expander 60 is also optimized.

It should be noted that the terms of equation (3) are approximations. For example, $f_s(t)$, the sliding friction force due to seals 72 and 76 will never exactly be zero; however, if it is at least one order of magnitude less than the forces $f_p(t)$ and $f_r(t)$, its effect will be minimal. Also, note the force $f_r(t)$ depends on the cross-sectional area of regenerator 84 adjacent cold space 70 when displacer 66 is moving in the direction of arrow 102, however, it depends on the crosssectional area of adapter 80 and warm end plug 90 when displacer 66 is moving in the direction opposite arrow 102.

Applicants have also discovered that as the volume of cold space 70 decreases while displacer 66 is moving in the direction opposite arrow 102, the viscosity of refrigeration gas is increased as it cools while flowing through regenerator 84. This has the effect of increasing $\tau$, so that $\tau$ is not constant over time. As will be seen shortly, this can be used to improve the performance of expander 60.

Figure 3:
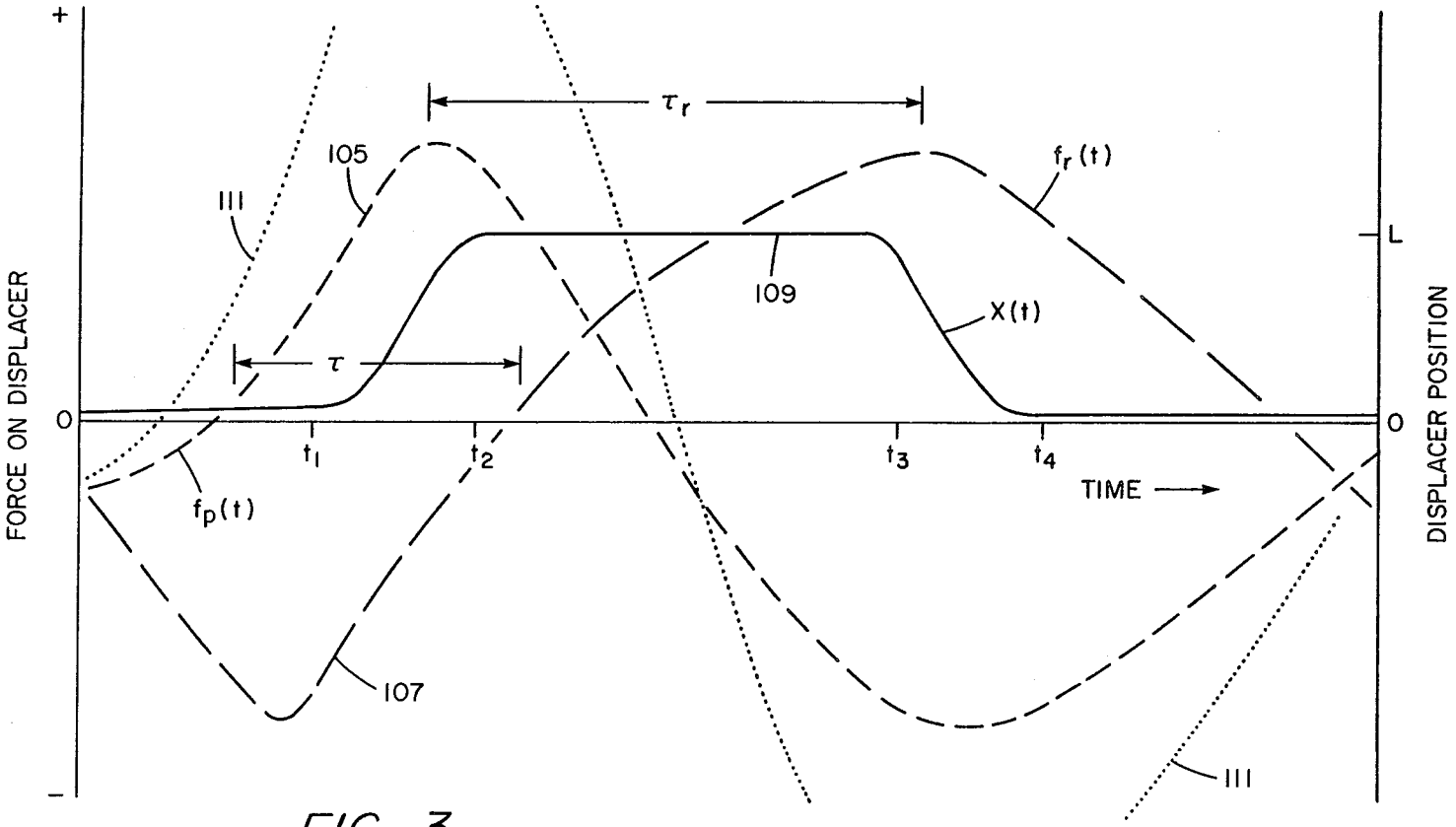
FIG. 3 is a plot of the forces on and position of the displacer with respect to time.

It can be understood from FIG. 3 how these forces are arranged to cause displacer 66 to move in proper phase with respect to the pressure variations of warm space 69. The short-dashed line 105 indicates the plunger force, $f_p(t)$, and the long-dashed line 107 denotes the regenerator force, $f_r(t)$. The solid line 109 denotes the position of displacer 66, $x(_t)$, with respect to time. Position function $x(_t)$ is derived from the sum of forces $f_p(t)$ and $f_r(t)$, and is limited by the physical length, L, equal to the difference between the length of main cavity 67 and regenerator 84. The solid line denotes the position of displacer 66, x(t), with respect to time. The position $x(t)=0$ corresponds to the point in the cycle shown in FIG. 1, namely when displacer 66 is adjacent the cold end 59 of expander 60, so that cold space 70 is of minimum size. Position $x(t)=L$ corresponds to the point in the cycle when displacer 66 is adjacent the warm end 58 of expander 60 so that warm space 69 is of minimum size. Before time $t_1$, displacer 66 remains near cold end 59 (that is, at the position shown in FIG. 1), principally because the force $f_r(t)$ is negative (positive force being indicated by the direction of arrow 102 in FIG. 1) and because force $f_p(t)$ is either negative or only slightly positive. The sum of these forces thus urges displacer 66 to remain adjacent the cold end 59. At time $t_1$, however, force $f_p(t)$ is positive and greater in magnitude than $f_r(t)$ thereby causing displacer 66 to move adjacent to the warm end 58 of expander 60. The exact time at which this occurs is dependent upon the regenerator time delay $\tau$, and should occur at a point near the maximum of $f_p(t)$ and hence also at the same time that the maximum gas pressure, $p_w(t)$ in warm space 69 occurs. This insures that the gas remains in warm space 69 until it is near a maximum pressure, one criterion of efficient operation of expander 60.

At time $t_2$, the gas pressure in warm space 69 is decreasing as well as force $f_p(t)$, however, $f_r(t)$ has now become positive so that the sum of both forces continue to urge displacer 66 to remain adjacent warm end 58. Not until time $t_3$, when $f_p(t)$ is sufficiently negative will the sum of forces be such to cause displacer 66 to begin to return to the position adjacent cold end 59. This returning motion has thus been delayed until the gas pressure $p_c(t)$, in cold space 70 is near a maximum.

As previously mentioned in connection with the discussion of FIG. 1, an increase in $\tau$, the time for gas to flow through regenerator 84, occurs between times $t_2$ and $t_3$. This increased time delay becomes evident by noticing that at time $t_1$ the two forces $f_p(t)$ and $f_r(t)$ are approximately 90° out of phase whereas at time $t_3$ they approach 180° out of phase. By time $t_4$, when the phase difference is returning to 90°, $f_p(t)$ has become sufficiently negative and greater in amplitude than $f_r(t)$ to cause displacer 66 to return to the position adjacent cold space 59. This increase in $\tau$ is due to an increase in the viscosity of the refrigeration gas caused as the volume of cold space 70 decreases.

Also shown in FIG. 3 by dotted line 111 is a partially cut-off plot of the plunger force associated with prior art expanders. The magnitude of the plunger force in prior expanders is much greater than the magnitude of the regenerator force, $f_r(t)$. Thus, friction seals or other plunger-motion adjusting apparatus were needed to retard the movement of plunger 78. Expanders according to the present invention avoid this difficulty by having the plunger force, $f_p(t)$, and the regenerator force, $f_r(t)$, approximately equal in magnitude.

It has also been found that existing expanders having rub or friction type seals at displacer seal 72 and/or plunger seal 76 may be retrofitted by replacing the rub seal with a clearance type seal as described herein and replacing the plunger 78 with a plunger having a diameter reduced by an amount proportional to the amount of sliding seal friction imparted by the friction seal. For example, one such regenerator was retrofitted by replacing a plunger diameter of 0.093 inches with one having a diameter of 0.065 inches. A displacer seal 72 having a sliding seal friction of 250 grams was replaced with a clearance type seal having a 200 microinch nominal clearance and sliding friction less than 10 grams. The size of spring volume 68 was 0.60 cubic inches.

Figure 4:
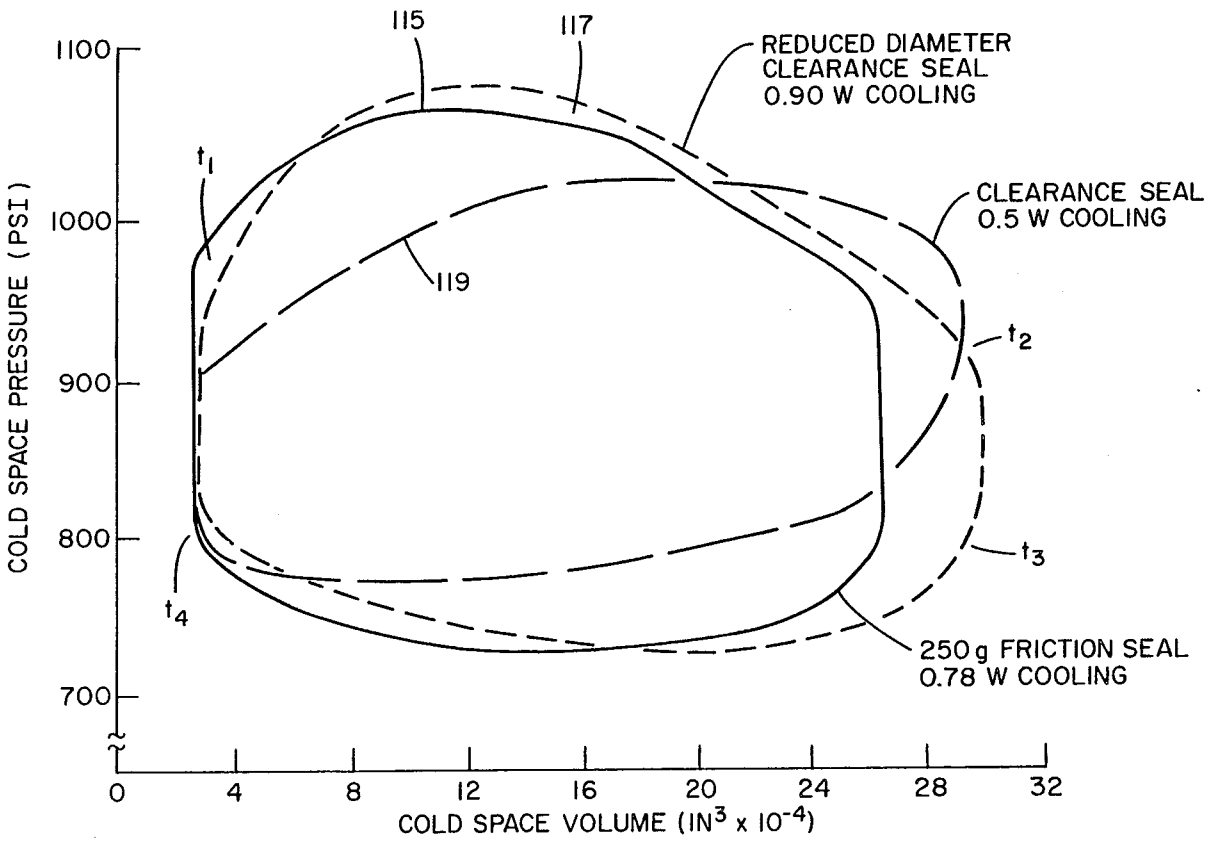
FIG. 4 is a plot of cold space pressure with respect to volume for prior art expanders and the present invention.

One commonly used measure of the cooling efficiency of such refrigerators is a pressure versus volume diagram of cold space 70. As shown in the cold space pressure-volume diagram of FIG. 4, this reduced diameter expander provided 0.9 watts of cooling power as compared to the 0.7 watts of cooling power provided by the original rub seal version. The rub seal version cold space pressure volume diagram is represented by the solid line 115, and that of the retrofitted version according to the present invention is represented by the short dashed line 117. Times $t_1$, $t_2$, $t_3$, $t_4$ as indicated correspond to those times indicated in FIG. 3, $t_1$ being the time of maximum pressure and minimum volume, $t_2$ being that of maximum pressure and maximum volume, $t_3$ that of minimum pressure and maximum volume and $t_4$ being that of minimum pressure and volume in cold space 70. Also shown by the long-dashed line 119 in FIG. 4 is the cold space pressure volume diagram of an expander where only the rub seal has been removed. It shows that this design is not maximally efficient and thus why others have been lead to believe that additional controls on the motion of displacer 66 are necessary. However, as Applicants have shown, it is evident that greater efficiency can be achieved by balancing the forces on both ends of the displacer and selecting a regenerator having the proper time delay characteristics.

It will be evident to those of skill in the art that other design parameters may be adjusted to vary and balance the forces on either end of the regenerator. For example, both the regenerator flow rate and the distance, L, travelled by displacer 66 can be adjusted to affect the time delay. It is felt, therefore, that this invention should not be restricted to the above-described preferred embodiment, but rather should be limited only by the spirit and scope of the following claims.

What is claimed is:

1. In an expander for use in a split Stirling cycle refrigeration system of the type wherein a displacer moves with reciprocating motion inside an expander housing, and wherein a plunger force and a regenerator force are formed on the displacer, the plunger force cyclically varying and having a time of minimum and maximum plunger force amplitude, and the regenerator force cyclically varying and having a time of minimum and maximum regenerator force amplitude, the improvement comprising:

(a) means for maintaining displacer forces, such that the maximum plunger force amplitude is substantially equal to the maximum regenerator force amplitude; and (b) means for adjusting a time difference, the time difference being the time between the time of maximum plunger force and the time of maximum regenerator force such that a measure of the cooling power of the refrigeration system is maximized.

2. Apparatus as in claim 1 and additionally comprising:

(c) means for adjusting the time difference between the time of minimum plunger force and the time of minimum regenerator force such that the measure of cooling power of the refrigeration system is maximized.

3. Apparatus as in claim 1 wherein the expander housing includes a warm space and a cold space formed therein, the warm space being filled with a refrigeration gas having a time varying pressure, and the cold space being filled with a pressurized refrigeration gas wherein the means for maintaining displacer forces include:

a regenerator, connected to the displacer adjacent the warm space and extending into the cold space, with a cross-sectional area such that the maximum regenerator force is equal to the maximum difference between the time varying warm space pressure and the cold space pressure, times the cross-sectional area of the regenerator, and is substantially equal to the maximum plunger force.

4. Apparatus as in claim 3 wherein the means for adjusting the time difference includes:

a regenerator, disposed so that refrigeration gas flows through the regenerator from the warm space to the cold space when the time varying warm space pressure is greater than the cold space pressure, the regenerator having a gas flow rate so that the time for refrigeration gas to flow from the warm space to the cold space is such that the measure of cooling efficiency is maximized.

5. Apparatus as in claim 4 wherein the regenerator is operably connected to the displacer so that the motion of the displacer in a direction causing minimum warm space volume is delayed until the time varying warm space pressure is substantially near a maximum.

6. Apparatus as in claim 3 wherein the means for adjusting the time difference includes:

a regenerator, disposed so that refrigeration gas flows through the regenerator from the cold space to the warm space when the time varying warm space pressure is less than the cold space pressure, the regenerator having a gas flow rate so that the time for refrigeration gas to flow from the cold space to the warm space is such that the measure of cooling efficiency is maximized.

7. Apparatus as in claim 6 wherein the regenerator is operably connected to the displacer so that the motion of the displacer in a direction causing maximum warm space volume is delayed until the cold space pressure is substantially near a minimum.

8. Apparatus as in claim 1 and additionally comprising:

(d) a clearance seal, disposed between the warm space and the cold space, to prevent flow of the refrigeration gas in the warm space directly to or from the cold space.

9. Apparatus as in claim 8 wherein said clearance seal is a sleeve of material fit to the outer diameter of the displacer.

10. Apparatus as in claim 9 wherein the sleeve is formed of polyimide compounded with molybdenum disulfide.

11. Apparatus as in claim 8 wherein said clearance seal is a coating formed on the outer diameter of the displacer.

12. Apparatus as in claim 11 wherein the coating is a polyimide compounded with Teflon.

13. In a displacer for use in a split Sterling cycle refrigeration system of the type wherein the displacer is disposed inside an expander housing having formed therein a spring volume filled with a refrigeration gas having a nearly constant pressure, and a warm space filled with a refrigeration gas having a pressure varying substantially sinusoidally in time about the spring volume constant pressure between a maximum warm space pressure and a minimum warm space pressure, and the expander housing also having a cold space therein, the cold space filled with a refrigeration gas and connected to the warm space such that the displacer reciprocates, in response to the warm space pressure variations, between a first position of maximum cold space pressure and a second position of minimum cold space pressure, the improvement comprising:

(a) a plunger, having two ends, disposed so that one end extends into the spring volume and the other end extends into the warm space, and also having a cross-sectional area such that a time varying plunger force equal to the plunger cross-sectional area times the difference between the spring volume pressure and the warm space pressure is developed across the plunger, the plunger force having a maximum magnitude;

(b) a regenerator, connected to the plunger, and having two ends, said regenerator disposed so that one end extends into the warm space and the other end extends into the cold space, and having a cross-sectional area such that a time varying regenerator force equal to the regenerator cross-sectional area times the difference between the warm space pressure and the cold space pressure is developed across the regenerator, the regenerator force having a maximum magnitude approximately equal to the plunger force maximum magnitude, and said regenerator also having a gas flow rate such that movement of the displacer from the first position to the second position is delayed until the warm space pressure is substantially equal to the maximum warm space pressure; and (c) a clearance seal, formed adjacent the outer surface of the displacer where the displacer contacts the expander housing, said seal such that a sliding friction force occurring as the displacer reciprocates is substantially less than the plunger force and the regenerator force.

14. A split Stirling cycle refrigeration system comprising:

an expander housing including a spring volume and a warm space formed therein, the spring volume filled with a refrigeration gas having a nearly constant pressure, and the warm space filled with a refrigeration gas having a time-varying pressure;

a displacer, positioned to move with reciprocating motion inside the expander housing, and so a plunger force and a regenerator force are formed on the displacer, the plunger force cyclically varying and having a time of minimum and maximum plunger force amplitude, and the regenerator force cyclically varying and having a time of minimum and maximum regenerator force amplitude;

a plunger, connected to the displacer adjacent the warm space and extending into the spring volume, with a cross-sectional area such that the maximum plunger force amplitude is equal to the maximum difference between the nearly constant spring volume pressure and the time-varying warm space pressure, times the cross-sectional area of the plunger, and the maximum plunger force amplitude is substantially equal to the maximum regenerator force; and means for adjusting a time difference, the time difference being the time between the time of maximum plunger force amplitude and the time of maximum regenerator force amplitude such that a measure of the cooling power of the refrigeration system is maximimized.

15. A split Stirling cycle refrigeration system comprising:

an expander housing a spring volume, a warm space, and a cold space formed therein, the spring volume filled with a refrigeration gas having a nearly constant pressure, the warm space filled with a refrigeration gas having a time-varying pressure, and the cold space filled with a refrigeration gas and connected to the warm space;

a displacer positioned to move with reciprocating motion inside the expander housing, and so a plunger force and a regenerator force are formed on the displacer;

a plunger, connected to the displacer adjacent the warm space and extending into the spring volume, with a cross-sectional area such that a time of maximum positive plunger force occurs when a maximum positive difference between the nearly constant spring volume pressure and the time-varying warm space pressure occurs, the maximum plunger force equal to this maximum positive pressure difference times the cross-sectional area of the plunger; and a regenerator, connected to the displacer adjacent the warm space and extending into the cold space, and connected as a regenerator force is formed on the displacer, with a cross-sectional area such that a time of maximum negative regenerator force occurs when a maximum negative difference between the time-varying warm space pressure and the cold space pressure occurs, the maximum negative force equal to this maximum negative pressure difference times the cross-sectional area of the regenerator, and with a gas flow rate so the time of maximum negative rengerator force occurs slightly before the time of maximum plunger force.

16. A split Stirling cycle refrigeration system comprising:

an expander housing including a warm space and a cold space formed therein, the cold space filled with a refrigeration gas having a nearly constant pressure, and the warm space filled with a refrigeration gas having a time-varying pressure;

a displacer, positioned to move with reciprocating motion inside the expander housing, and so a plunger force and a regenerator force are formed on the displacer, the plunger force cyclically varying and having a time of minimum and maximum plunger force amplitude, and the regenerator force cyclically varying and having a time of minimum and maximum regenerator force amplitude;

a regenerator, connected to the displacer adjacent the warm space and extending into the cold space, with a cross-sectional area such that the maximum regenerator force amplitude is equal to the maximum difference between the time varying warm space pressure and the cold space pressure, times the cross-sectional area of the regenerator, and is substantially equal to the maximum plunger force amplitude; and means for adjusting a time difference, the time difference being the time between the time of maximum plunger force amplitude and the time of maximum regenerator force amplitude such that a measure of the cooling power of the refrigeration system is maximized.

17. Apparatus as in claim 16 wherein the means for adjusting the time difference comprises:

a regenerator, disposed so refrigeration gas flows through the regenerator from the warm space to the cold space when the time varying warm space pressure is greater than the cold space pressure, and the regenerator having a gas flow rate so the time for refrigeration gas to flow from the warm space to the cold space is such that the measure of cooling efficiency is maximized.

18. Apparatus as in claim 17 wherein the regenerator is operably connected to the displacer so the motion of the displacer in a direction causing minimum warm space volume is delayed until the time varying warm space pressure is substantially near a maximum.

19. Apparatus as in claim 16 wherein the means for adjusting the time difference comprises:

a regenerator, disposed so refrigeration gas flows through the regenerator from the cold space to the warm space when time varying warm space pressure is less than the cold space pressure, the regenerator having a gas flow rate so the time for refrigration gas to flow from the cold space to the warm space is such that the measure of cooling efficiency is maximized.

20. Apparatus as in claim 19 wherein the regenerator is operably connected to the displacer so that the motion of the displacer in a direction causing maximum warm space volume is delayed until the cold space pressure is substantially near a minimum.

* * * * *